US007983431B2

(12) United States Patent
Fukuda

(10) Patent No.: US 7,983,431 B2
(45) Date of Patent: Jul. 19, 2011

(54) BONE CONDUCTION DEVICE AND TYMPANUM THEREOF

(75) Inventor: Mikio Fukuda, Suginami-ku (JP)

(73) Assignee: Temco Japan Co., Ltd, (JP)

( * ) Notice: Subject to any disclaimer, the term of this patent is extended or adjusted under 35 U.S.C. 154(b) by 1216 days.

(21) Appl. No.: 11/570,790

(22) PCT Filed: Jun. 15, 2005

(86) PCT No.: PCT/JP2005/010917

§ 371 (c)(1),
(2), (4) Date: Dec. 18, 2006

(87) PCT Pub. No.: WO2005/125266

PCT Pub. Date: Dec. 29, 2005

(65) Prior Publication Data

US 2007/0160239 A1 Jul. 12, 2007

(30) Foreign Application Priority Data

Jun. 18, 2004 (JP) ..... 2004-180912
Nov. 2, 2004 (JP) ..... 2004-319255

(51) Int. Cl.
*H04R 25/00* (2006.01)

(52) U.S. Cl. ..... 381/151; 381/326; 381/380

(58) Field of Classification Search ..... 381/151, 381/326, 380, 396
See application file for complete search history.

(56) References Cited

U.S. PATENT DOCUMENTS 2,202,906 A * 6/1940 Hawley ..... 381/380
2,459,325 A * 1/1949 Knowles ..... 381/151
2,482,044 A * 9/1949 Vernier ..... 381/151
5,337,364 A * 8/1994 Fitch ..... 381/151
6,141,427 A * 10/2000 Fukuda ..... 381/151

FOREIGN PATENT DOCUMENTS

JP 11-355871 12/1999
JP 2001-313989 11/2001
JP 2002-199480 7/2002
JP 2003-340370 12/2003
KR 2001111653 A * 12/2001

* cited by examiner

*Primary Examiner* — Curtis Kuntz
*Assistant Examiner* — Ryan Robinson
(74) *Attorney, Agent, or Firm* — Schmeiser, Olsen & Watts, LLP

(57) ABSTRACT

The object is to provide a bone conduction device and its tympanum, wherein the bone conduction device can be efficiently mounted without generating a dead space in a case having a limited installation space such as a cellular phone's case having a large display screen. A magnetic sound converter device has an outer magnetic structure wherein a voice coil (3) is mounted on a center magnetic pole (2) of a yoke (1) and a magnet (4) is arranged on the outer side of the voice coil (3). The yoke (1) and the center magnetic pole (2) thereof are vertically long, the magnet (4) is arranged on the short side edge parts on the both sides of the yoke, and a tympanum fixing part (6) is arranged on the outer side of each magnet (4) on a magnet arrangement axis.

10 Claims, 5 Drawing Sheets

BONE CONDUCTION DEVICE AND TYMPANUM THEREOF

TECHNICAL FIELD

The present invention relates to a bone conduction device and a tympanum thereof, and more particularly to a bone conduction device and a tympanum thereof, wherein the bone conduction device comprises: a speaker of a type, which enables a user to catch a voice sound by means of a tympanum having been abutted on a head portion of the user so as to transmit the tympanum's vibrations to the user's bone tissue; and, a bone conduction microphone for picking up a bone conduction sound.

BACKGROUND ART

As a conventional bone conduction device, one shown in FIG. 8 has been known in the art. A bone conduction speaker of such a conventional bone conduction device has a construction in which: provided is a yoke 51 provided with a center magnetic pole 52, on which pole 52 a voice coil 56 is wound and mounted thereon; the yoke extends in four directions to form four extension parts, disposed on opposite two ones 53, 53 of which parts are magnets 55, 55, wherein the remaining two ones of the extension parts carry tympanum fixing parts 54, 54 disposed upright on these parts; and, the tympanum 57 is fixedly mounted on each of the tympanum fixing parts 54, 54 (Japanese Patent No. 2967777).

On the other hand, a bone conduction speaker shown in FIG. 9 comprises: a cylindrical case 61 provided with a tympanum 62 in its upper surface; a cylindrical magnet 63 fitted in the cylindrical case 61 to extend along an inner surface of the case 61; a yoke 65, which is provided with a center magnetic pole 64 in its center and fitted in a lower part of the case 61; and, a voice coil 66 disposed so as to circumscribe the center magnetic pole 64 of the yoke 65 (Japanese Patent application Laid-Open No.: Sho 57-10114 gazette).

Another bone conduction speaker shown in FIG. 10 is known, wherein: provided in opposite sides of a yoke 70 are a pair of branched legs 71, 71 each of which is fitted in each of voice coils 72, 72; a magnet 73 is disposed between the voice coils 72, 72; and, a tympanum 75 is disposed on the magnet 73 through a plate 74 (Japanese Patent application Laid-Open No.: 2001-313989 gazette). This is one in which two pieces of the voice coils 72 are disposed, so that this one generally larger in size than the above-described one.

In recent years, the bone conduction speaker described above has been used in a condition in which the bone conduction speaker is incorporated in a cellular phone. Under such circumstances, since a need exists in the latest cellular phone for increasing in area size a display screen in a front surface of the cellular phone as large as possible, a space available for installation of a speaker in the cellular phone is limited only to a laterally elongated space positioned over the display screen.

However, in case of the conventional type of bone conduction speaker described above, any one of the speakers has an aspect ratio of approximately 1:1 to assume a circle-like form. Due to this, it is necessary for the speaker to be a scaled-down one, a diameter of which is smaller in length than a shorter side of a laterally elongated installation space appearing in an upper part of a case of a cellular phone. This leads to a shortage in output power of the bone conduction speaker. In order to use a large-sized bone conduction speaker which is capable of providing a sufficient amount of output power in use, it is necessary to scale-up the case of the bone conduction speaker in size. In this case, however, there is a fear that a considerable loss in space occurs in the cellular phone.

The above description is also true in the case of a bone conduction microphone, which must be incorporated in a limited installation space.

Patent document 1: Japanese Patent No.: 2967777;

Patent document 2: Japanese Patent application Laid-Open No.: Sho 57-10114 gazette; and Patent document 3: Japanese Patent application Laid-Open No.: 2001-313989 gazette.

DISCLOSURE OF THE INVENTION

Problems to be Solves by the Invention

As described above, in case of the conventional bone conduction speaker, its aspect ratio is approximately 1:1. Due to this, it is necessary for the bone conduction speaker to be scaled down in size as a whole in the case where the speaker is incorporated in a laterally elongated space as is in the latest cellular phone in the art. However, there is a fear that this leads to a shortage in output power of the bone conduction speaker in use.

Consequently, it is an object of the present invention to provide a bone conduction device and its tympanum, both of which can be efficiently incorporated in a case having a limited installation space such as a cellular phone's case, without producing any dead space in the case, wherein the cellular phone's case is provided with a large-sized display screen.

Means for Solving the Problems

The above problems are solved according to the present invention by providing: a bone conduction device, which is a magnetic type acoustic converter device having an outer magnetic type construction in which a voice coil is mounted on a center magnetic pole of a yoke, while a magnet is disposed outside the voice coil, characterized in that: each of the yoke and the center magnetic pole is vertically elongated in shape; the magnet is disposed on a side end part of each of opposite shorter sides of the yoke; and, a tympanum fixing part for fixing a tympanum is disposed outside each of the magnets, wherein the tympanum fixing part is aligned with a magnet arrangement axis on which the magnet is arranged.

The tympanum fixing part is constructed of a shoulder part which is integrally formed with the side end part in each of the opposite shorter sides of the yoke. Or, the tympanum fixing part is constructed of a spacer formed of non-magnetic material, wherein the spacer is disposed on the side end part in each of the opposite shorter sides of the yoke. Or, the tympanum fixing part is constructed of a side surface of a shorter side of a box case, wherein the box case contains the yoke, the voice coil and the magnet there.

The tympanum is constructed of: a support plate, which is formed of non-magnetic material and provided with a longitudinally elongated opening, wherein the opening is formed so as to extend over the entire length of the tympanum; and, a tympanum member, which is formed of magnetic material and has its vibrations supported by the support plate, wherein the tympanum member is disposed on the opening. In this case, preferably: the tympanum member is slightly smaller in size than the opening of the support plate; and, the tympanum member is provided with a fixing part in each of opposite sides of its intermediate part, wherein the fixing part is fixed to a side end part of a longer side of the opening.

The tympanum is provided with a bent part which is constructed of a side end part of a shorter side in each of opposite sides of its support plate, wherein the side end part has been extended, bent and formed into the bent part; and, the tympanum has the bent part fixed to the shoulder part, an outer side surface of the spacer, or a side surface of a shorter side of the box case so that the tympanum is installed. Preferably, the support plate is fixed to the shoulder part or to the spacer by laser welding.

Effect of the Invention

The bone conduction device of the present invention assumes a longitudinally elongated shape as a whole. Since a width of a shorter side of the device depends on a shorter width of the voice coil, it is possible to restrict a width of a shorter side of the speaker unit. Due to this, the bone conduction device of the present invention is best adapted to the use in a cellular phone and the like which is provided with a large display screen together with an available laterally elongated narrow installation space. In this case, any dead space is not produced in the cellular phone and the like when the bone conduction device of the present invention is installed therein. Further, as the effect of the present invention, it is possible to obtain a sufficient amount of output power of the device in the use of a cellular phone.

Further, the bone conduction speaker and its tympanum both according to the present invention are simple in construction. In addition, it is possible for the tympanum to be improved in compliance. Still further, the tympanum is capable of being mounted on the yoke by laser welding in an easy manner. Consequently, the bone conduction device of the present invention is easy in production and sufficiently strong in physical strength. Due to this, particularly, in case of the invention described in claim 4, the device defined in the claim may enjoy its sufficiently large impact resistance.

BEST MODE FOR CARRYING OUT THE INVENTION

Preferred embodiments for carrying out the present invention will be described with reference to the accompanying drawings. In the following description, a bone conduction speaker used in a bone conduction device will be described. Although the following description will be made with respect to the bone conduction speaker used in the bone conduction device, it is also possible to apply substantially the same description as that of the bone conduction speaker to a bone conduction microphone. Consequently, a description of such a bone conduction microphone will be omitted.

The bone conduction speaker of the present invention is constructed of: a yoke 1, which is provided with a center magnetic pole 2 assuming a longitudinally elongated shape such as a rectangle, an oval, an ellipse, or the like, wherein the yoke 1 assumes substantially the same longitudinally elongated shape as that of the center magnetic pole 2; a voice coil 3 wound around the center magnetic pole 2 to assume a longitudinally elongated shape as is in the yoke described above; a pair of magnets 4, 4 mounted together with the voice coil 3 to locate in a side end part of a shorter side of the yoke 1; and, a tympanum 5 fixedly mounted on the yoke 1. Incidentally, in meaning, the term "longitudinally elongated" described here depends on the disposition of the device, and is therefore equal in meaning to the term "laterally elongated" when the device is laterally disposed.

The yoke 1 shown in FIGS. 1 to 4 is provided with an integrally-formed shoulder parts 6 in its shorter side. A bottom surface of the shoulder part 6 shown in the drawings is raised in height relative to a bottom surface of the yoke 1. It is also possible for the bottom surface of the shoulder part 6 to be made flush with the bottom surface of the yoke 1. The magnet 4 is disposed inside the shoulder part 6 so as to extend along an inner side surface of the shoulder part 6. Incidentally, each of the shoulder part 6 and the magnet 4 may assume a straight shape or may assume a circular arc shape.

The voice coil 3 is wound around the center magnetic pole 2 to assume a shape extending along the center magnetic pole 2 having been longitudinally elongated. Any component is not disposed on the opposite sides adjacent to longer sides of the voice coil 3. Due to this, the width of a shorter side depends on the length of a shorter side of the voice coil 3. Consequently, it is possible for the bone conduction speaker of the present invention to decrease its shorter side in width relative to any speaker of the conventional type in a condition in which the speaker of the present invention keeps its output efficiency.

Preferably, the tympanum 5 is constructed of: a support plate 7, which is formed from non-magnetic material and provided with a longitudinally elongated opening 8, wherein the opening 8 is formed so as to extend over the entire length of the tympanum 5; and, a tympanum member 9, which is formed from magnetic material and has its vibrations supported by the support plate 7, wherein the tympanum member 9 is disposed on the opening 8 (FIG. 2). For example, the tympanum member 9 assumes a rectangular shape which is slightly smaller in size than the opening 8 of the support plate 7. Further, the tympanum member 9 is provided with a pair of fixing parts 10, 10 in its opposite sides. These fixing parts 10, 10 are fixed to an intermediate area of a side edge part of a longer side of the opening 8. The tympanum member 9 is installed in an area over the opening 8 through its fixing parts 10, 10 in a manner such that the tympanum 9 is movably supported in the opening 8 without interfering with a peripheral parts of the opening 8, thereby allowing the tympanum 5 to keep its compliance at a large value. The reference numeral 11 denotes a threaded hole through which the tympanum 5 is threadably engaged with the unit case not shown in the drawings.

In the tympanum 5 used in the embodiments shown in FIGS. 1 to 4, the tympanum 5 has each of opposite ends of its support plate 7 extended and bent at right angles to form a bent part 12. In this case, an inner surface end part of this bent part 12 is fixed to an outer side surface of the shoulder part 6. Preferably, such fixing is realized by laser welding.

In fixing the bent part 12 to the shoulder part 6, it is necessary to provide a gap between an upper surface of the center magnetic pole 2 and the tympanum member 9 (see FIG. 3). In order to provide the gap, a removable sheet a width of which corresponds to the gap is disposed on the center magnetic pole 2. Under such circumstances, the bent part 12 is fixed to the shoulder part 6. After that, the removable sheet is pulled out. This is a simple and effective method for providing the gap by pulling out the removable sheet.

Incidentally, it is also possible to fix an end part of the support plate 7 onto the shoulder part 6 by forming the shoulder part 6 slightly higher than the center magnetic pole 2 in a condition in which: the bent part 12 is not provided in the support plate 7; or, the bent part 12 is provided in the support plate 7.

FIG. 4 shows a magnetic circuit M used in the bone conduction speaker having the above construction. In this case, the magnetic circuit M is constructed of: the yoke 1; the magnet 4; the tympanum member 9; and, the center magnetic pole 2.

In the embodiment shown in FIG. 5: in place of the above shoulder part 6, a spacer 14 which is formed from non-magnetic material is used as the fixing part of the tympanum 5. It is possible for the spacer 14 to assume a straight shape or a curved shape as is in the case of the shoulder part 6. On the other hand, it is necessary for the spacer 14 to be slightly higher in height than the center magnetic pole 2. The spacer 14 is fixed to an edge part of each of opposite sides of the yoke 1 by bonding, fastening a screw, and like techniques.

It is possible that: the support plate 7 of the tympanum 5 in this embodiment is provided with the bent part 12 as is in the above; and, the bent part 12 is fixed to an outer side surface of the spacer 14. It is also possible that: an end part of the support plate 7 is fixed to an upper surface of the spacer 14 (see FIG. 5).

The embodiment shown in FIGS. 6 and 7 has the same construction as that of the previous embodiment shown in FIGS. 1 to 4, except that the embodiment shown FIG. 6 is not provided with the bent part 6. The embodiment shown FIG. 6 is provided with a box case 15 formed from non-magnetic material. Contained in the box case 15 are: the yoke 1; the voice coil 3 installed in the yoke 1; and, the magnet 4.

The box case 15, which is formed from non-magnetic material such as SUS, aluminum, brass and the like, has the yoke 1 tightly received therein, and is provided with an opening part 17 in its bottom surface, wherein the opening part 17 is encircled with a peripheral edge part 16. Further, the box case 15 is provided with a lead wire outlet groove 18 in an appropriate area of its side surface.

In this case, the voice coil 3 is wound around the center magnetic pole 2. Further, the yoke 1 in which the magnet 4 is installed is received in the box case 15, wherein the yoke 1 has its peripheral edge part fixed to the corresponding peripheral edge part 16 of the box case 15 by welding, bonding or like techniques.

The tympanum 5 is similar in construction to that of the embodiment shown in FIG. 1. More specifically, the tympanum 5 is disposed on the box case 15 so as to cover the box case 15 with the tympanum 5, namely, so as to have an inner side surface of a bent part 12 of the tympanum 5 abut on an outer side surface of a side wall arranged in the side of a shorter side of the box case 15. Then, the inner side surface of the bent part 12 is fixed to the outer side surface of the box case 15 by welding, bonding or like techniques. It is a matter of course that it is also possible in construction to have the bent part 12 positioned inside the box case 15 thereby allowing the outer side surface of the bent part 12 to be fixed to the inner side surface of the side wall in the side of the shorter side of the box case 15.

Incidentally, in keeping a predetermined gap between an upper surface of the center magnetic pole 2 and the tympanum 5, it is effective to dispose a removable sheet on the center magnetic pole 2 prior to a time when the bent portion 12 is fixed, as is in the case of the above-mentioned embodiment.

In this case of the embodiment, it is possible that the tympanum 5 is fixed to the box case 15 through a sufficiently large contact area. Due to this, such fixing may be made firmer, without fail. Further, since all of the yoke 1, voice coil 3 and the magnet 4 are contained in the box case 15, any one of contact areas of individual these components increases, which makes such fixing more reliable and still firmer thereby allowing to provide a drop-resistant and impact-resistant product. Furthermore, since it is possible to additionally provide a threaded hole in the box case 15, it is possible to mount the box case 15 on the device's body through such threaded hole. Such a possible additional provision makes the box case 15 improved in design freedom. This is an additional advantage of the present invention.

While the present invention has been described in detail to some extent with reference to the preferred embodiments thereof, it will be understood by those skilled in the art that various changes in form and details may be made therein without departing from the spirit and scope of the present invention as defined by the appended claims. In other words, the present invention is not limited in scope by its specified embodiments.

Figure 1:
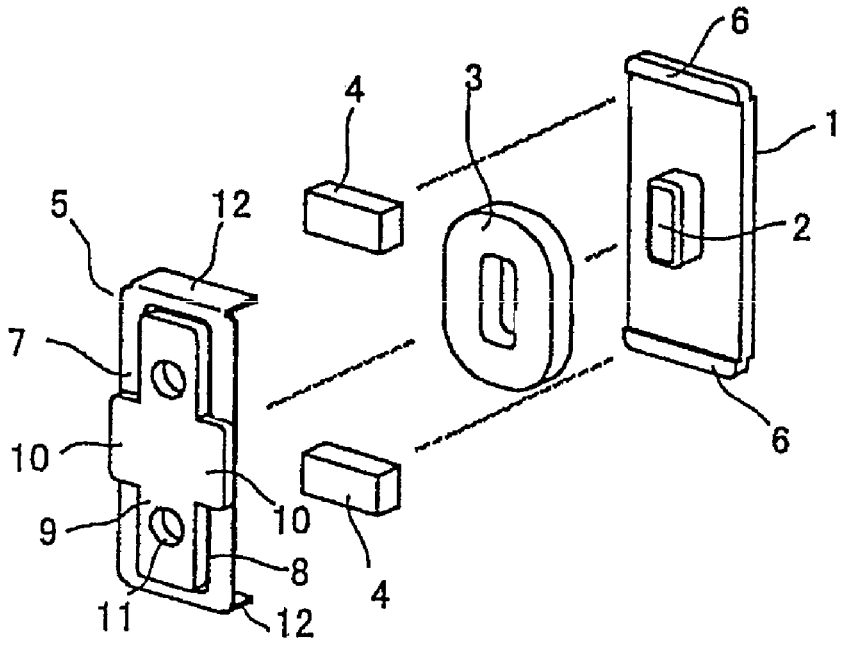
[FIG. 1] is an exploded perspective view of the bone conduction speaker according to the present invention.
Figure 2:
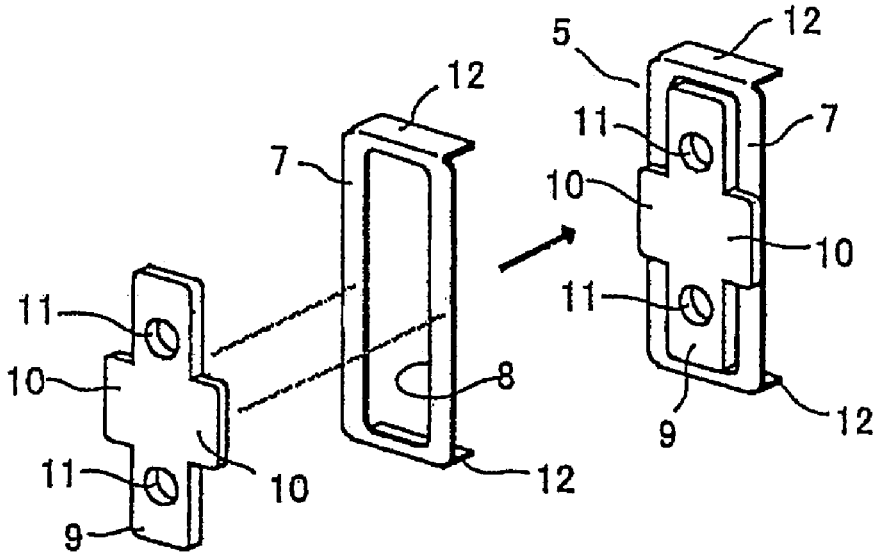
[FIG. 2] is an exploded perspective view of the tympanum in the bone conduction speaker according to the present invention.
Figure 3:
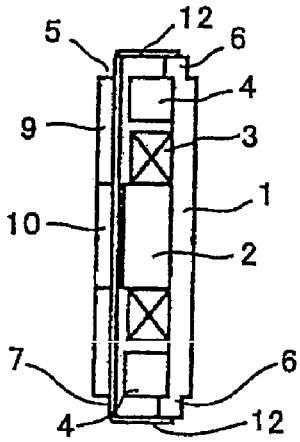
[FIG. 3] is a longitudinal sectional view of the bone conduction speaker according to the present invention.
Figure 4:
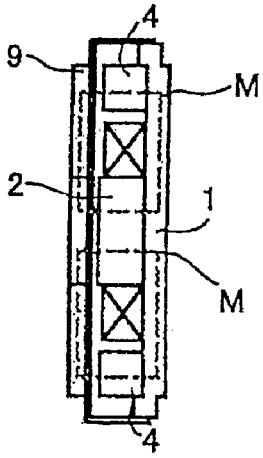
[FIG. 4] is a view illustrating the magnetic circuit of the bone conduction speaker according to the present invention.
Figure 5:
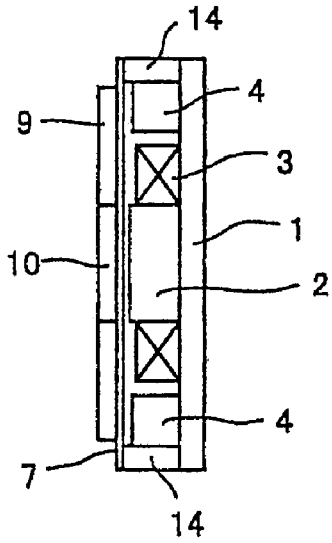
[FIG. 5] is a longitudinal sectional view of another example of the bone conduction speaker in construction according to the present invention.
Figure 6:
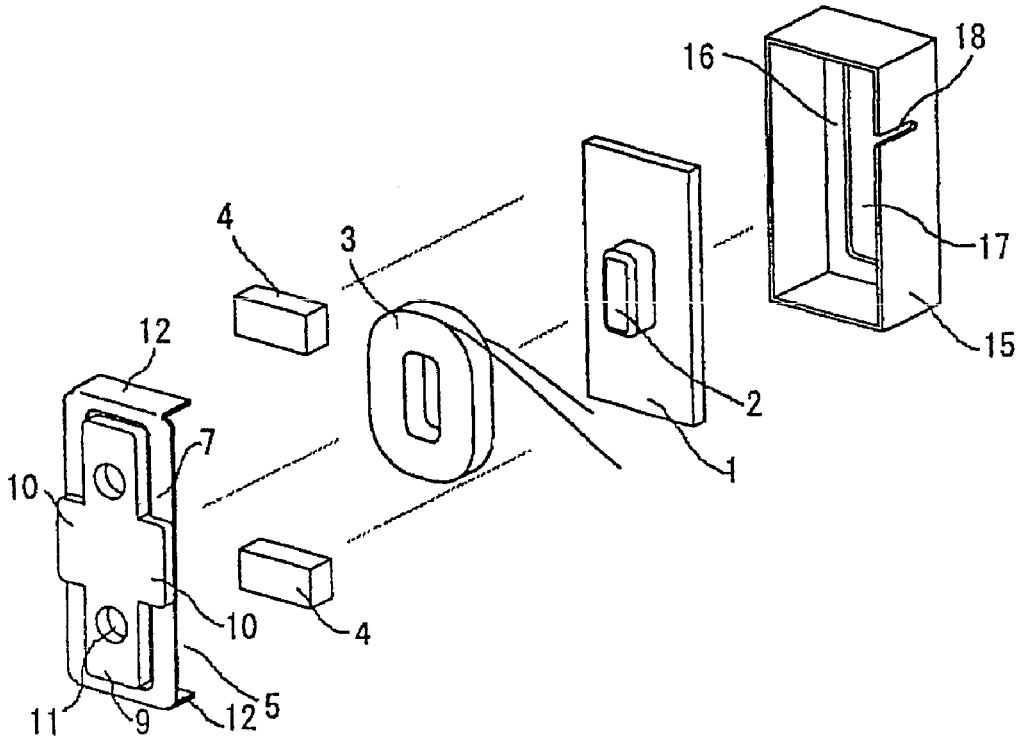
[FIG. 6] is an exploded perspective view of further another example of the bone conduction speaker in construction according to the present invention.
Figure 7:
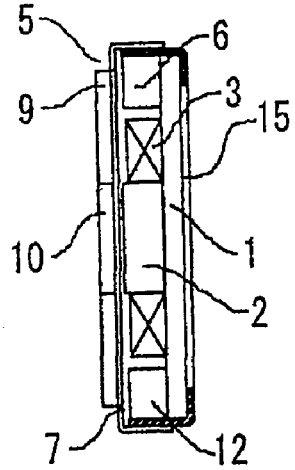
[FIG. 7] is a longitudinal sectional view of further another example of the bone conduction speaker in construction according to the present invention.
Figure 8:
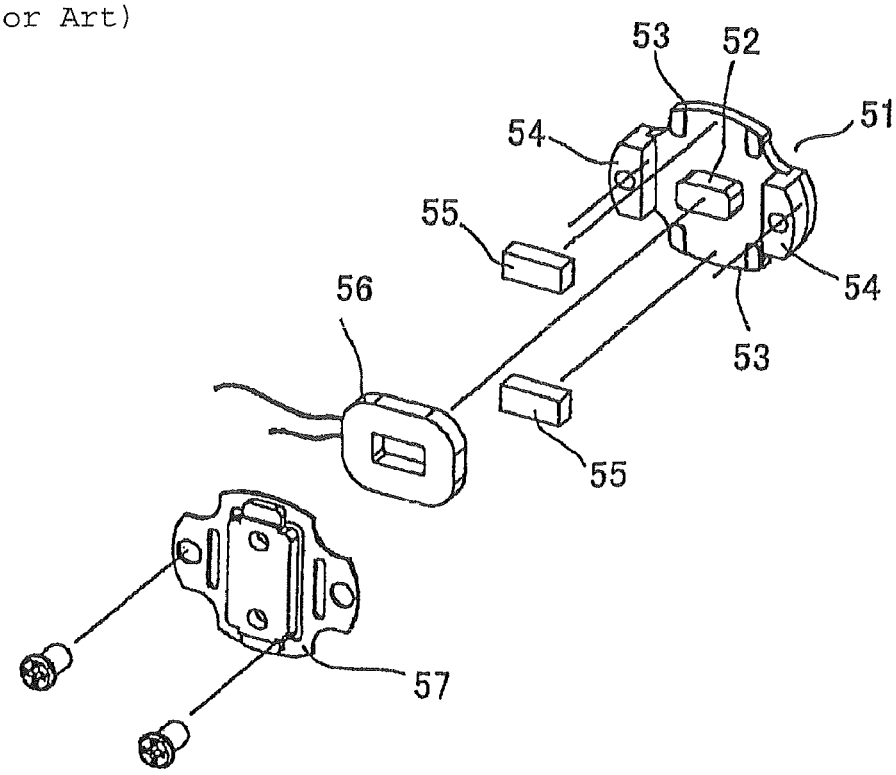
FIG. 8 (Prior Art)
[FIG. 8] is an exploded perspective view of the conventional bone conduction speaker, illustrating the speaker in construction.
Figure 9:
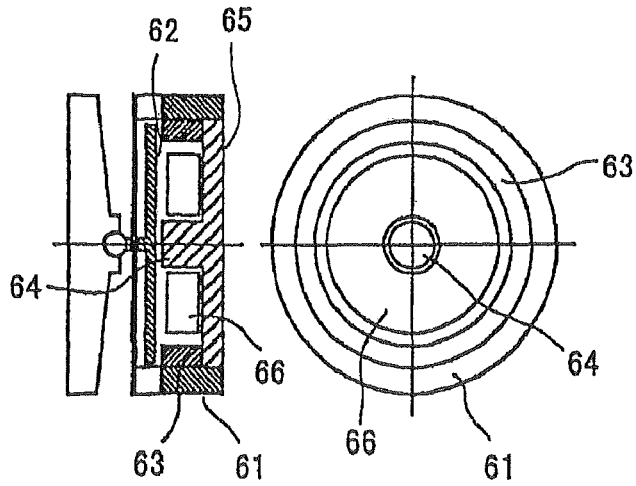
FIG. 9 (Prior Art)
[FIG. 9] is a sectional view of the conventional bone conduction speaker, illustrating another example of the speaker in construction.
Figure 10:
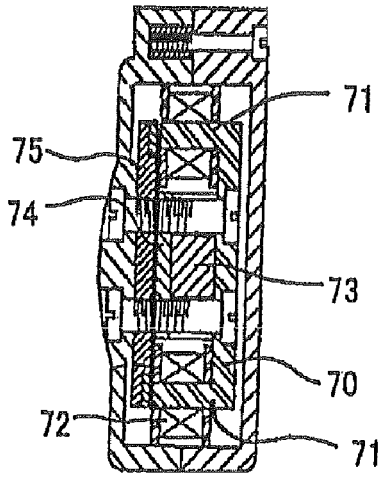
FIG. 10 Prior Art)
[FIG. 10] is a sectional view of the conventional bone conduction speaker, illustrating further an other example of the speaker in construction.

The invention claimed is;

1. A bone conduction device, which is a magnetic type acoustic converter device having an outer magnetic type construction in which a voice coil is mounted on a center magnetic pole of a yoke, while magnets are disposed outside said voice coil, characterized in that: each of said yoke and said center magnetic pole is vertically elongated in shape; each said magnet is disposed on a side end part of each of opposite shorter sides of said yoke; and, a tympanum fixing part for fixing a tympanum is disposed outside each of said magnets, wherein said tympanum fixing part is aligned with each magnet arrangement axes on which each of said magnet is arranged, and said tympanum has each of its opposite ends extended and bent at an end part to form a bent part; and has said bent part fixed to said tympanum fixing part.

2. The bone conduction device as set forth in claim 1, characterized in that: said tympanum fixing part is constructed of a shoulder part which is integrally formed with said side end part in each of said opposite shorter sides of said yoke.

3. The bone conduction device as set forth in claim 1, characterized in that: said tympanum fixing part is constructed of a spacer formed from non-magnetic material, wherein said spacer is disposed on said side end part in each of said opposite shorter sides of said yoke.

4. The bone conduction device as set forth in claim 1, characterized in that: said tympanum fixing part is constructed of a side surface of a shorter side of a box case, wherein said box case contains said yoke, said voice coil and said magnet therein.

5. The bone conduction device as set forth in claim 1, characterized in that said tympanum is constructed of: a support plate, which is formed from non-magnetic material and provided with a longitudinally elongated opening, wherein said opening is formed so as to extend over the entire length of said tympanum; and, a tympanum member, which is formed from magnetic material and has its vibrations supported by said support plate, wherein said tympanum member is disposed on said opening.

6. The bone conduction device as set forth in claim 5, characterized in that: said tympanum member is slightly smaller in size than said opening of said support plate; and, said tympanum member is provided with a fixing part in each of opposite sides of its intermediate part, wherein said fixing part is fixed to a side end part of a longer side of said opening.

7. The bone conduction device as set forth in claim 1, characterized in that: said bent part is fixed to said tympanum fixing part by laser welding.

8. A bone conduction device characterized in that the device includes a tympanum comprising: a support plate, which is formed from non-magnetic material and provided with a longitudinally elongated opening formed over the substantially entire length of said support plate; and, a tympanum member, which is disposed in said opening and its vibrations supported by said support plate, wherein said tympanum member is formed from magnetic material, wherein said tympanum member is slightly smaller in size than said opening of said support plate, wherein said tympanum member is provided with a fixing part in each of opposite sides of its intermediate part and has said fixing part extended outward, wherein said fixing part is fixed to a side edge part of a longer side of said opening and said tympanum has each of opposite ends of said support plate extended and bent to form a bent part; and has said bent part fixed to said tympanum fixing part of the yoke.

9. The bone conduction device of claim 1, wherein said bent parts are bent at right angles.

10. The bone conduction device of claim 8, wherein said bent parts are bent at right angles.

* * * * *